United States Patent [19]

Meshaka

[11] Patent Number: 4,972,895

[45] Date of Patent: Nov. 27, 1990

[54] DRAPERY SNAP ATTACHMENTS

[76] Inventor: Leeia B. Meshaka, 8500 SW. 87th Ter., Miami, Fla. 33143

[21] Appl. No.: 430,151

[22] Filed: Nov. 1, 1989

[51] Int. Cl.[5] ..... A47H 1/00

[52] U.S. Cl. ..... 160/330; 160/348

[58] Field of Search ..... 160/345, 346, 347, 330, 160/123, 126, 124, 348; 16/87.2, 87.4, 93 D, 94 D, 95 D, 96 D

[56] References Cited

U.S. PATENT DOCUMENTS

| | | | |
|---|---|---|---|
| 2,115,593 | 4/1938 | Strube | 16/87.2 |
| 2,934,782 | 5/1960 | Wootton | 16/93 |
| 3,173,169 | 3/1965 | George | 160/330 X |
| 3,222,710 | 12/1965 | Potye | 16/87.2 |
| 3,296,651 | 1/1967 | Baker | 16/87.4 |
| 3,372,730 | 3/1968 | Kalder | 160/348 |
| 3,503,434 | 3/1970 | Ford | 160/345 |
| 3,522,621 | 8/1970 | Ford et al. | 16/87.4 R |
| 3,616,486 | 11/1971 | Ford et al. | 160/345 X |
| 3,626,429 | 12/1971 | Toder | 16/87.2 |
| 3,682,226 | 8/1972 | Ford | 160/330 |
| 3,916,975 | 11/1975 | Lawson | 160/330 |
| 3,951,197 | 4/1976 | Cohen et al. | 160/346 |
| 3,992,749 | 11/1976 | Getchell | 16/93 |
| 4,073,331 | 2/1978 | Zilver | 160/348 |
| 4,115,899 | 9/1978 | Ford | 16/87.4 |
| 4,153,097 | 5/1979 | Pettibone | 160/330 |
| 4,230,171 | 10/1980 | Baker | 160/345 X |
| 4,261,080 | 4/1981 | Ryan | 160/348 X |
| 4,344,210 | 8/1982 | Ryan | 160/348 X |
| 4,584,737 | 4/1986 | Ohman | 16/87.4 |

OTHER PUBLICATIONS

Kirsch Drapery Hardware Price List, (Feb. 6, 1989), pp. 44, 70, 71, 75.

*Primary Examiner*—David M. Purol

[57] ABSTRACT

A pleated drapery is readily attached without pins to an overhead, essentially horizontal traverse track, and more particularly, to cooperating snap members rigidly attached to an positioned below coresponding carriers movable along the track in a fixed orientation facing the pleated drapery. A T-shaped member having a stem member, a base member extending perpendicularly to the stem member and a cooperating snap member fixed to the base member and facing away from the stem member is provided for each pleated portion of the drape to be attached. The stem member is constructed and arranged for insertion between and attached to a pair of folds forming a pleat. The fixed orientation of the cooperating snap members fixed to the carriers insures that the drapery is not distorted unduly in the vicinity of the pleat when a cooperating snap member fixed to a base member engages a cooperating snap member rigidly fixed to a selected one of the carriers, as is the case when snap members are secured flatwise to the major surface of a curtain that is subsequently pleated.

6 Claims, 2 Drawing Sheets

DRAPERY SNAP ATTACHMENTS

FIELD OF THE INVENTION

This invention relates to a drapery snap attachment for attaching pleated drapery or curtains relative to an overhead, essentially horizontal track without distorting the pleated drapery or curtain unduly.

BACKGROUND OF THE INVENTION

Drapes and curtains are usually suspended from essentially horizontal tracks, which are fixed to either the ceiling or a portion of a side wall in close proximity to the ceiling of a room, to cover a window opening. The track extends in the vicinity of either a window or a wall portion that is desired to be covered with the drapery or curtain. The track includes a plurality of carriers that are movable along the length of the track, either by sliding relative to a longitudinal path defined between a pair of longitudinally extending, laterally spaced elongated rails or by rolling along the rails by virtue of wheels or rollers that rotate relative to the body of the carriers.

Traditionally, drapery systems have been attached to carriers by means of a double hook. The double hook includes a lower hook that terminates in an upwardly extending pointed pin that is embedded into the upper portion of the curtain or drape and an upper end which includes a downwardly turned pin hook that extends into an eye of said carrier to which eye the upper end hook is engaged so that the curtain or drapery is suspended in spaced relation along the length of the upper edge portion of the curtain or drapery to a series of carriers that move longitudinally along the length of the overhead essentially horizontal track to provide a series of supports for the curtain or drapery. The carriers may be attached to one another through flexible strings that limit the spacing of adjacent carriers from one another and to ensure essentially uniform loading from support point to support point along the length of the curtain or drapery.

Curtains or drapes of the type just described present a difficult problem whenever it is necessary to launder or change the drapery or curtain. Each pin must be removed from the drapery in order to prepare the drapery or curtain for laundering. Then, when the laundered drapery or curtain is reinstalled, each pin must be attached to the drapery or curtain in a time consuming and uncomfortable operation.

In order to provide a more efficient operation than the pinning and unpinning operations just described, the drapery art has developed the use of mating male and female snap members, one of which is supported by one of the carriers that move longitudinally of the overhead track and the other of which is attached to the upper portion of the curtain or drape. While it is an easier job to use a snap system having cooperative snap fit members than a pinning and unpinning system which preceded the snapping and unsnapping system, the prior art snap systems developed prior to this invention were beneficial only in use with flat curtains having an elongated snap tape containing one of the pairs of cooperating snap fitting members sewn directly or otherwise attached as by sewing material directly onto the top portion of the drapery or curtain and in a position to engage the other snap fitting member that was carried by the one or another of the carriers that move longitudinally along the overhead essentially horizontally extending track. However, flat curtains are undesirable and pleated curtains are preferred. Pleated curtains have a series of pleats spaced approximately uniformly along the length of the curtain. It is not possible to sew an elongated snap tape onto a pleated curtain because the pleats interrupt the smooth surface of the curtain and, therefore, a sewing machine cannot possibly follow the change in direction of the surface of the curtain or drapery in the vicinity of the folds forming the pleats. Even if the attachment is performed by hand, the pleated upper portion of the curtain or drapery becomes unduly distorted because of the impossibility of attaching the tape that supports the cooperating snap members to the surface of the curtain or drapery.

The following patents disclose the use of cooperating snap fit members to attach a curtain or drapery to an overhead support:

U.S. Pat. No. 2,934,782 to Wootton, issued May 3, 1960; U.S. Pat. No. 3,296,651 to Baker, issued January 10, 1067; U.S. Pat. No. 3,626,429 to Toder, issued December 7, 1971; Ford, U.S. Pat. No. 4,115,899 issued Sept. 26, 1978; and Ohman, U.S. Pat. No. 4,584,737, issued Apr. 29, 1986. In addition, U.S. Pat. No. 3,992,749 to Getchell, issued Nov. 23, 1976, shows a method of attaching a drape or curtain in such a manner as to adjust height of the drape from the floor, and U.S. Pat. No. 4,153,097 to Pettibone, issued May 8, 1979 discloses cooperating snap members to attach a skirt to the perimeter of a table. The Ford U.S. Pat. No. 4,115,899 discloses the use of cooperating snap members to hang the upper edge of a curtain and a liner on opposite sides of a center line of a vertical plane passing through the central portion of an overhead horizontal track from which both the curtain and the liner are supported. The cooperating snap means of the Ford patent are offset vertically, which necessitates employing a drapery and a liner of different vertical dimensions.

It is easily observed from a study of the previously disclosed patents that were found in a preliminary novelty search that none of the devices of the disclosed prior art enabled a snap fit to be made between a curtain or drapery and a supporting carrier that is movable along an overhead essentially horizontal track without causing undue deformation of the attached upper portion of the curtain or drapery when the cooperating snap fit members engage one another.

BRIEF DESCRIPTION OF THIS INVENTION

This invention provides means to readily attach or remove a pleated drapery or curtain relative to an overhead, essentially horizontal traverse track without distorting the pleated drapery or curtain unduly by using pairs of cooperating snap members, one of which is supported on the base member of a T-shaped member having a stem member rigidly attached between the folds of a pleated portion to serve as the connection between the base member and the curtain or drapery. The other cooperating snap member of each pair is attached in fixed orientation to a carrier movable along said track. The stem member of said T-shaped member is a piece of stiff cloth or mesh directly sewn or otherwise rigidly attached in flatwise relation between the folds of a pleat in said pleated drapery or curtain. The fixed orientations of the cooperating snap fit members are parallel so that the drapery or curtain is not distorted or twisted in the vicinity of the attachment of the snap members to the drapery or curtain when the cooperating snap members engage one another.

The benefits of this invention will be better understood in the light of a description of certain preferred embodiments thereon that follows.

BRIEF DESCRIPTION OF THE DRAWINGS

In the drawings that form part of a description of the preferred embodiments of this invention, and wherein like reference numbers refer to like structural elements.

DESCRIPTION OF PREFERRED EMBODIMENTS

Figure 7:
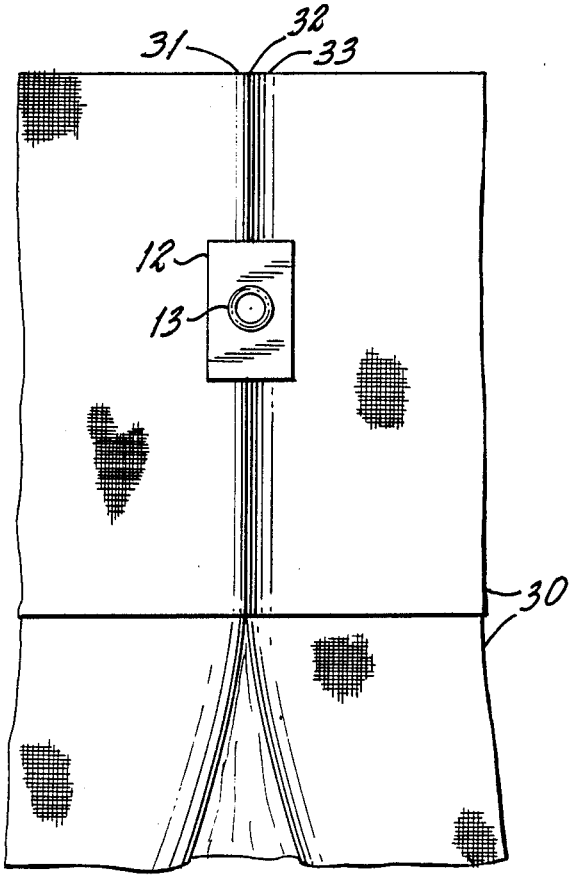
FIG. 7 is a fragmentary frontal view of a portion of the pleated curtain of FIG. 6 shown in an extended condition.

Referring to the drawings, and particularly FIG. 7, a drapery or curtain 30 is shown provided with a series of multiple pleats 31, 32 and 33 (only one being shown). The multiple pleats are spaced along the upper edge portion of the curtain or drapery 30. While the present invention is shown in conjunction with a drapery having triple pleats, it is understood that the present invention may be used with drapes having any odd number of pleats at each pleated portion such as one, three, five, seven, etc. Multiple pleats 31, 32, 33 form spaced groups of pleats along the length of the drapery.

Figure 3:
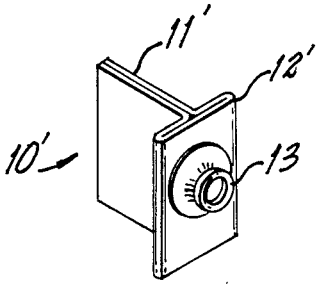
FIG. 3 is a perspective view of an alternate embodiment of a cooperating snap member fixed to the head portion of a T-shaped folded stiff cloth member
Figure 4:
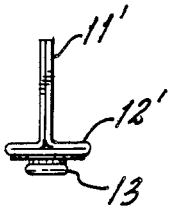
FIG. 4 is a top view of the FIG. 3 embodiment.
Figure 8:
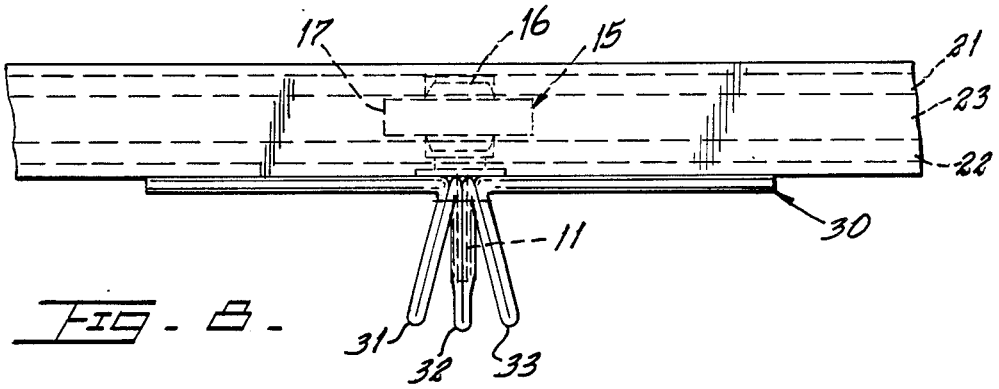
FIG. 8 is an enlarged top view of a portion of FIG. 7 showing a cooperating snap member applied to a pleat of a drapery or curtain aligned with but spaced from a carrier provided with at least one cooperating snap fit member engagable with a snap fit member fixed to a plastic mesh member or a folded stiff cloth member secured to the folds of the central pleat in said pleated curtain or drapery to be hung.
Figure 9:
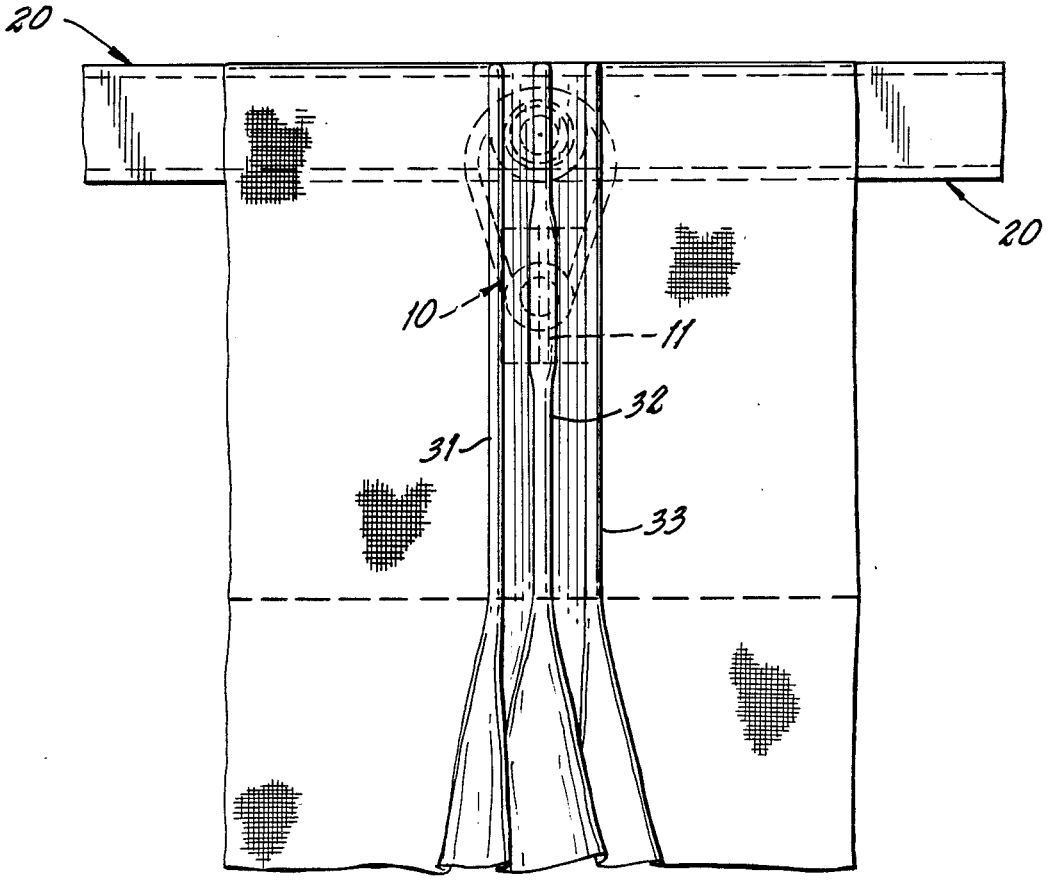
FIG. 9 is a fragmentary vertical view of a portion of a pleated curtain or drapery supported to an essentially horizontal overhead track using cooperating snap fit members conforming to this invention.
Figure 10:
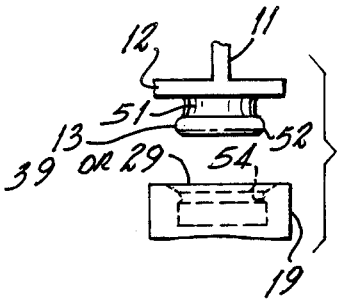
FIG. 10 is an enlarged view of the ends of a pair of cooperating snap fit male and female members, showing how the male member is shaped with a reduced thickness intermediate portion and ending in a slightly widened portion and the female member has a complementary shape to enable the snap fit members to engage one another and interfit readily when properly aligned and moved toward one another.

Each of the multiple pleats 31, 32, 33 contains a plurality of outward and inward folds continuing relative to one another. Inserted into the middle pleat 32 of each multiple pleat is a stem member 11 of a T-shaped member supporting a cooperating snap fit member 10. The stem member 11 may be in the form of a plastic mesh stem member shown in FIGS. 1 and 2 extending in a perpendicular direction from a base member 12, or the T-shaped member may comprise a piece of stiff cloth in the form of a stem 11' that is bent and reversely folded to form a base 12' of fabric extending in a perpendicular direction from stem 11' as shown in FIGS. 3 and 4. Either base member 12 or 12' supports a male snap fit member 13 that faces away from said drapery. In the embodiment of FIGS. 3 and 4, the stem 11' and base 12' are of unitary fabric construction, whereas in the embodiment of FIGS. 1 and 2, the stem of the T-shaped member is a framed plastic mesh stem member 11 that is attached at its outer end to a separate base member 12 on which the male snap fit member 13 is rigidly supported. In either event, the stem member 11 of the FIGS. 1 and 2 embodiment or the stem member 11' of the unitary rigid or stiff cloth member 10' of FIGS. 3 and 4 fits flat within the folds of middle pleat 32 of a multiple pleat 31, 32, 33 arrangement formed along the upper edge portion of the drapery or curtain 30. The stem 11 or 11' of either embodiment is sewn into the center pleat 32 of the multiple pleated portion 31, 32, 33 in flatwise relation between the folds of center pleat 32, as shown in FIG. 8 so that the first cooperating snap fit member 13 extends in fixed orientation in a direction that is normal to and facing away from the stem and the vertical plane in which the curtain 30 hangs when the latter is hung in its extended configuration shown in FIG. 7.

Figure 1:
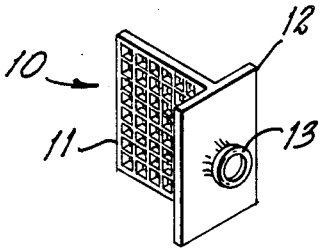
FIG. 1 is a perspective view of a first embodiment of a cooperating snap member fixed to a stiff plastic mesh member constructed and arranged to be sewn between the folds of a pleat in a pleated curtain.
Figure 5:
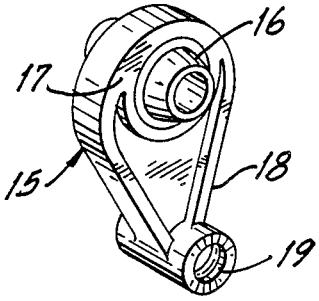
FIG. 5 is a perspective view of a carrier comprising a vertical member with a lower portion supporting a pair of snap members constructed and arranged to cooperate with the cooperating snap member of either FIGS. 1 and 2 or that of FIGS. 3 and 4.
Figure 6:
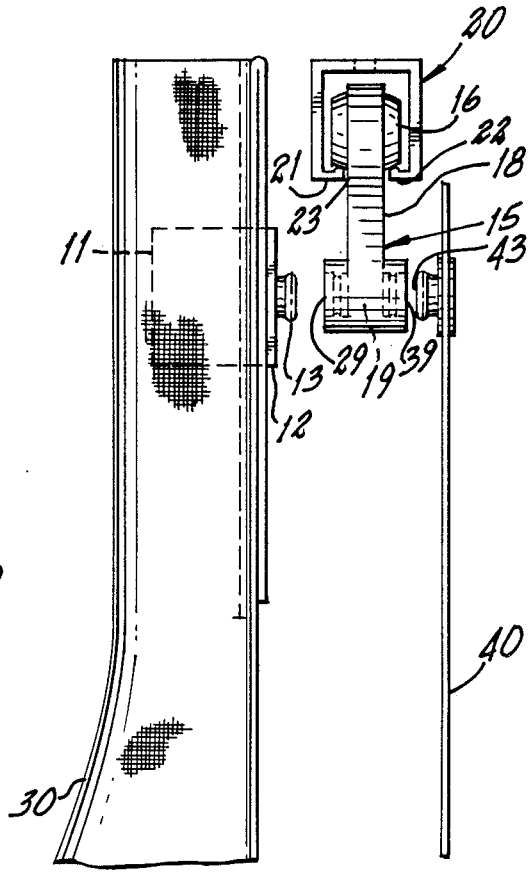
FIG. 6 is a fragmentary cross sectional view of an overhead, essentially horizontal track showing how one of a plurality of carriers of FIG. 5 is arranged for engagement of its oppositely directed cooperating snap members with cooperating snap members of a pleated drape spaced to one side and a flat cover drape spaced to the other side of said carrier.

Referring to FIG. 5, a carrier 15 is shown, which carrier includes a pair of wheels 16 or a single rotatable roller carried by an upper housing 17 that extends downwardly below the wheels 16 into a vertical member 18 which rigidly supports a bottom portion 19 from which extend in opposite directions therefrom a pair of female snap fit members 29 and 39. FIG. 6 shows the carrier 15 supported on a track 20 which comprises a pair of transversely spaced elongated track rails 21 and 22 defining an elongated space 23 between said track rails 21 and 22. Thus, wheels 16 or the roller that may be used in lieu of the wheels 16 rotate in rotatable support on the upper surfaces of elongated track rails 21 and 22 to enable each carrier 15 to be movable longitudinally of the overhead rail 20. Means well known in the art is provided to support rail 20 from either the ceiling or a side wall adjacent to the ceiling of a room in which the track is to be installed for supporting a curtain or drapery. A typical ceiling support for an overhead horizontal track for drapery is shown in FIG. 1 of U.S. Pat. No. 4,584,737 to Ohman, the disclosure of which may be incorporated herein by reference, and may be used to support the overhead track 20 used to support the carriers 15 in the present apparatus.

A plurality of carriers 15 is provided along the length of the overhead essentially horizontal track 20. Each carrier 15 has its vertical member 18 extending through the elongated space 23 between track rails 21 and 22. The female snap fit members 29 and 39 extend in opposite directions from the bottom portion 19 of each carrier 15.

If the tracks and carrier apparatus is designed to support both a pleated drapery and an unpleated cover member 40, as shown in FIG. 6, a cooperating male snap fit member 43 is attached to unpleated cover member 40 to align with each middle pleat 32 of the pleated curtain 30. Carriers 15 are spaced equally along track 20 and male snap members 13 of pleated curtain 30 engage female snap members 29 that face pleated curtain 30 while male snap members 43 of cover member 40 engage female snap members 39 that face away from pleated curtain 30.

If the drape or curtain is to be used without a cover member, then it is only necessary to provide multiple pleats 31, 32, 33 along the length of the drapery or curtain, and insert a first cooperating snap fit member 13 so that its stem member 11 or 11' is sewn into the central pleat 32 of a pleated portion 31, 32, 33 and the cooperating snap fit member 13 is brought into engagement with either cooperating snap fit members 29 or 39 depending on which side of the track the curtain or drapery is to hang.

Figure 2:
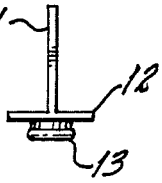
FIG. 2 is a top view of the member shown in FIG. 1.

Since each stem member 11 of the first embodiment of FIGS. 1 and 2 or each fabric stem member 11' of the FIG. 3 and 4 embodiment is rigidly sewn into a central pleat 32, the cooperating male snap fit member 13 extends in fixed orientation relative to a vertical plane. Each of the female snap fit members 29 and 39 is constrained by virtue of its rigid attachment to bottom portion 19 of carrier 15 so that the orientation of the female snap fit members 29 and 39 are capable of alignment with each of the cooperating male snap fit members 13.

Each male snap fit member 13 has a reduced intermediate portion 51 and an enlarged end portion 52, and each female snap fit member 29 and 39 has an end structure 54 complementary to portions 51 and 52. As a result, it is easy to align the cooperating snap fit members and engage them to one another. In other words, male cooperating snap fit members 13 can be applied to corresponding female cooperating snap fit members 29 or 39 without causing rotation of the rigidly supported snap fit members 29 and 39 that are rigidly attached to each of the carriers 15 along the length of the horizontal track 20.

Previously, the use of buckram provided with spaced cooperating snap fit members 12 in prior art structures caused the drapery to be distorted in the vicinity of each of the multiple pleats 31, 32, 33. The fact that all the stems 11 and 11' fixed to the cooperating male snap fit members 10 extend in planes normal to the plane in which the extended drape 30 hangs provides a more rigid support for the male snap fit member 10 so as to facilitate their engagement with corresponding female snap fit member 29 or 39.

It is understood that the cooperating snap fit member associated with the stem member 11 or 11' that is sewn to the center pleat 32 of a multiple pleat section may be a female cooperating snap fit member and the cooperating snap fit members carried by the carriers 15 at the bottom of the vertical members 19 thereof can be male cooperating snap fit members without departing from the gist of this invention. When the cooperating snap fit members engage one another along the length of the rail 20, the drapery is not distorted unduly as would be the case if the device supporting the cooperating snap fit members directly attached to the curtain or drapery were attached directly to the major surface of the drapery as is the case with the drapery shown either in the previously discussed U.S. Pat. No. 4,115,899 to Ford or in U.S. Pat. No. 4,584,737 to Ohman.

According to the provisions of the patent statues, the principle, preferred construction and mode of operation of this invention have been explained and what is now considered to be the best embodiments and variations thereof have been described and illustrated. However, it should be understood that the invention may be practiced otherwise than as specifically illustrated and described within the scope of the claimed subject matter that follows.

What is claimed is:

1. Means to readily attach or remove a movable, pleated drapery or curtain having a series of spaced pleated portions, each comprising at least one pleat having a pair of folds, relative to an overhead, essentially horizontal track without unduly distorting said pleated drapery or curtain as a result of said attachment for use with a carrier for one of said pleated portions, said carrier being supported for movement along said track, and a first cooperating snap member rigidly attached to said carrier and suspended therefrom in fixed orientation about a movable vertical axis movable with said carrier, said means comprising a rigid T-shaped member having a stem member, a base member extending perpendicularly from said stem member, a second cooperating snap member fixed to said base member and oriented to face away from said stem member to engage said first cooperating snap member, said stem member comprising a piece of stiff cloth or mesh constructed and arranged to be rigidly secured in flatwise relation between one of said pairs of folds forming said at least one of said pleats to attach said base member to said pleat, whereby when said first cooperating snap member fixed to said carrier is engaged by said second cooperating snap member carried by said T-shaped member, said drapery or curtain is not unduly distorted in said pleated portion.

2. Means as in claim 1, wherein said pleated portions each comprises an odd number of pleats, including a central pleat, wherein said stem member is constructed and arranged to be rigidly secured between the folds forming said central pleat of said odd number of pleats.

3. Means as in claim 1, characterized by the absence of attachment pins.

4. Means to readily attach or remove a movable pleated drapery or curtain having a series of spaced pleated portions, each of said pleated portions having at least one associated pleat formed from a pair of folds, to a series of carriers mounted for movement along an essentially horizontal overhead track, each of said carriers supporting a first cooperating snap member depending downward therefrom and rigidly attached thereto in a fixed orientation to face said curtain, a T-shaped member corresponding to at least some of said pleated portions, each said T-shaped member having a rigid stem member constructed and arranged to be rigidly secured between the pair of folds forming an associated pleat, a base member integral with and extending normal to said stem member and a second cooperating snap member fixed to said base member in a fixed orientation facing away from said stem member, each said second cooperating snap member being constructed and arranged to engage a first cooperating snap member corresponding thereto in such a manner that said cooperating snap members engage each other without undue distortion of said drapery or curtain as a result of said engagement.

5. Means as in claim 4, wherein each of said pleated portions comprises an odd number of pleats including a central pleat, wherein said stem member is constructed and arranged to be rigidly secured between the folds forming said central pleat.

6. Means as in claim 4, characterized by the absence of attachment pins.

* * * * *

UNITED STATES PATENT AND TRADEMARK OFFICE

CERTIFICATE OF CORRECTION

PATENT NO. : 4,972,895

DATED : November 27, 1990

INVENTOR(S) : Leeia B. Meshaka

It is certified that error appears in the above-identified patent and that said Letters Patent is hereby corrected as shown below:

Column 2, line 6, after "pleats"insert --comprise a series of reversely bent folds that --.

Signed and Sealed this

Twenty-first Day of July, 1992

*Attest:*

DOUGLAS B. COMER

*Attesting Officer*

*Acting Commissioner of Patents and Trademarks*